United States Patent [19]

Ellithorpe

[11] Patent Number: 5,056,750

[45] Date of Patent: Oct. 15, 1991

[54] SUPPORT COLUMN

[76] Inventor: Rick Ellithorpe, 87 Woodridge Close, S.W., Calgary, Alta., Canada, T2W 5M2

[21] Appl. No.: 531,649

[22] Filed: Jun. 1, 1990

[30] Foreign Application Priority Data

Aug. 1, 1989 [CA] Canada ..... 607259

[51] Int. Cl.[5] ..... E04G 25/00

[52] U.S. Cl. ..... 248/354.3; 52/126.6

[58] Field of Search ..... 248/354.3, 405, 161, 248/157, 125; 52/126.6, 126.5

[56] References Cited

U.S. PATENT DOCUMENTS

| | | | |
|---|---|---|---|
| 136,200 | 5/1911 | Reichert . | |
| 1,022,036 | 4/1912 | McLendon et al. | 248/354.5 X |
| 1,719,528 | 7/1929 | Beckley et al. | 248/354.3 X |
| 2,280,220 | 4/1942 | Crosby | 52/126.6 |
| 2,535,141 | 12/1950 | Kenney et al. | 248/354.3 |
| 3,742,662 | 7/1973 | Ballou | 248/354.3 X |
| 3,782,052 | 1/1974 | Vetonitz | 248/354.3 X |
| 4,581,863 | 4/1986 | Thaler | 248/354.3 X |
| 4,870,789 | 10/1989 | Clark | 248/354.3 X |

FOREIGN PATENT DOCUMENTS

| | | | |
|---|---|---|---|
| 642534 | 6/1962 | Canada | 254/75 |
| 0675000 | 11/1963 | Canada . | |
| 0704587 | 3/1965 | Canada . | |
| 0049056 | 6/1974 | Canada . | |
| 0068118 | 5/1975 | Canada . | |
| 970353 | 7/1975 | Canada | 254/119 |

*Primary Examiner*—Alvin C. Chin-Shue
*Assistant Examiner*—Korie H. Chan

[57] ABSTRACT

A load bearing support for supporting beams, grids and diaphragms, includes a head, a saddle, and a column. The saddle includes a height adjustment device, and a moment coupling device, purposed to be arranged substantially symmetrically about and substantially parallel to the longitudinal axis of the column. The height adjustment device includes a plurality of rods threadably engageable with the head. The moment coupling device includes an unthreaded central member located between the rods and slidably engageable with the head.

10 Claims, 2 Drawing Sheets

SUPPORT COLUMN

FIELD OF THE INVENTION

This invention relates to load bearing support columns. More specifically, this invention relates to adjustable support columns for supporting beams, grids, diaphragms or the like.

DESCRIPTION OF PRIOR ART

It is common in support columns, such as lifting jacks for the lifting and supporting of ceilings, to use a single, threaded support rod in a column. See, for example, Canadian patents 136,200 to Beichert and 704,587 to Russo. As well, support assemblies are known having central threaded members to which flanking members are attached, such as in Canadian patent 949,056 to Ratliff. Similarly, supports are known which provide upwardly and inwardly inclined jack units having levers and braces, such as chains, between angled bases and opposite converging tops of screw jacks, such that when the braces are tightened, the heads function as jaws. See, for example, Canadian patent 642,535 to Teel. Additionally, columnar structures are known in which adjustment of column height requires adjustment not only of the thickness of baseplates but also of nuts and bolts throughout the column. See, for example, Canadian patents 675,000 to Dielman and 968,118 to Antoniou. Such prior columnar structures, however, do not provide a moment resisting member centrally placed between height adjustment means. As well, a complex combination of a jack screw, levelling nut, tension plate and U-shaped bolt (arranged transversely rather than longitudinally with respect to a beam and passing through the tension plate to be fastened on the lower side thereof by hold down nuts) is known from Canadian patent 970,353 to McMichael.

The above-mentioned prior art arrangements do not adequately incorporate telescopic elements or provide substantial moment carrying capacity. Moreover, although some of the above-mentioned patents describe devices suitable for permanent support, others of them are more suitable for temporary support. In addition, the above-mentioned prior art patents present devices that are somewhat complex, both in their structure and in their manner of use.

SUMMARY OF THE INVENTION

It is an object of the present invention to provide a structure which obviates the above-mentioned drawbacks of the prior art. Specifically, the applicant has found that a moment carrying capacity provided by a saddle comprising a load engaging member provided with threaded rods flanking a telescope assembly, substantially reduces "hinge connection" at the top of columns. As well, applicant has found that such a telescopic assembly absorbs bending loads whereas such threaded rods carry compressive loads only and are not subject to bending loads. As well, the applicant has found that such a saddle may be adjustable in height even when loaded and that use of such a saddle may provide substantial lateral restraint against twisting of beams inserted therein.

Accordingly, the present invention provides a load bearing support comprising a head surmounting a column and a saddle disposed on said head, said saddle including height adjustment means for adjusting the overall height of the support, and moment coupling means, arranged substantially symmetrically about and substantially parallel to the longitudinal axis of said column and extending upwardly to form a load engaging member, said moment coupling means comprising a central member slidably engageable with said head, and said head comprising support means disposed substantially perpendicularly to the longitudinal axis of said column, and substantially symmetrically about the upper end of said column, upper surfaces of said support means cooperating with and supporting said height adjustment means.

Also according to the present invention there is provided a load bearing support comprising a head surmounted by a column and a saddle disposed below said head, said column extending upwardly to form a load engaging member, said saddle including height adjustment means for adjusting the overall height of the support, and moment coupling means arranged substantially symmetrically about and substantially parallel to the longitudinal axis of said column, said moment coupling means comprising a central member slidably engageable with said head, said head comprising support means disposed substantially perpendicularly to the longitudinal axis of said column, and substantially symmetrically about the lower end of said column, lower surfaces of said support means cooperating with and supported by said height adjustment means.

The heavy load beam support, or telepost of the invention is primarily designed for permanent residential and commercial constructions, but is also suitable for use as a temporary support for beams. The arrangement provides greater height capacity than existing adjustable columns, while the preferably U-shaped saddle resists rotation of the beam about its longitudinal axis more efficiently than with conventional equipment. The moment carrying capacity provided by the saddle and telescoping assembly eliminates "hinge connection" at the top of the column.

Moreover, the screw threads of the height adjustment means carry compressive loads only, and are not subject to bending loads, which are carried in the telescopic sections.

Modular design permits saddle assemblies for various widths of beams to be mated with columns of various heights, thereby facilitating reduction in dealer inventory. It also allows for simple field cutting of columns to length without the need for re-welding. A base plate complete with anchor holes allows a moment carrying connection to the footing. The support of the invention may be proportioned so as to be framed into a normal stud wall.

BRIEF DESCRIPTION OF THE DRAWINGS

Embodiments of the invention will now be described in greater detail and will be better understood when read in conjunction with the accompanying drawings, in which.

DESCRIPTION OF THE PREFERRED EMBODIMENTS

Figure 1:
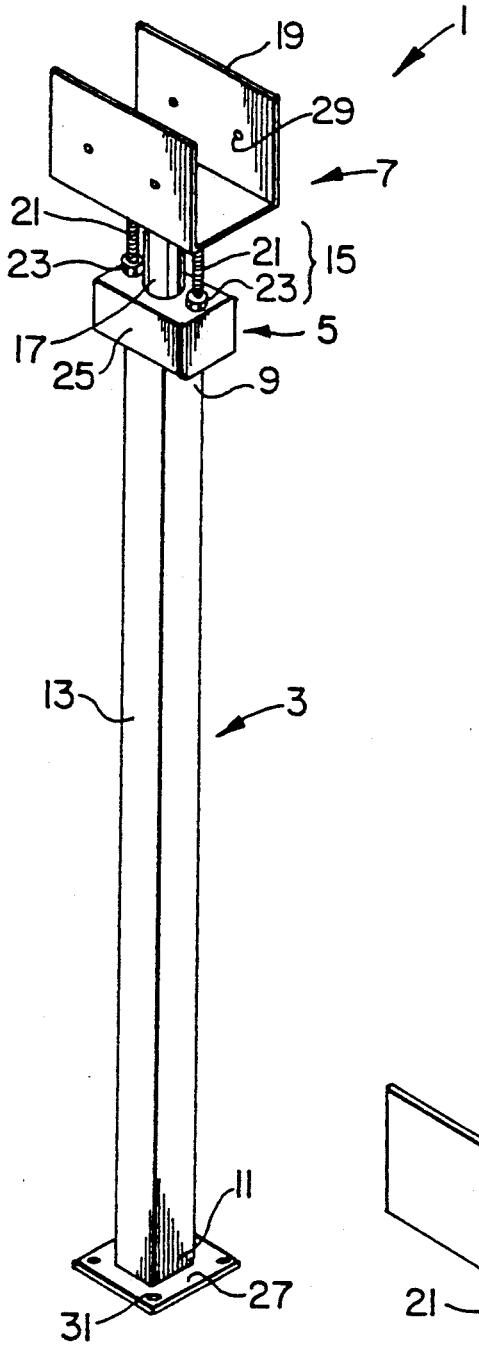
FIG. 1 is a perspective view of a support column.
Figure 2:
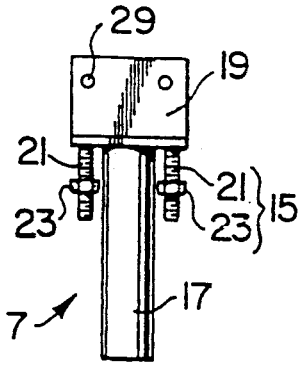
FIG. 2 is a front view of the saddle of the support column shown in FIG. 1.
Figure 3:
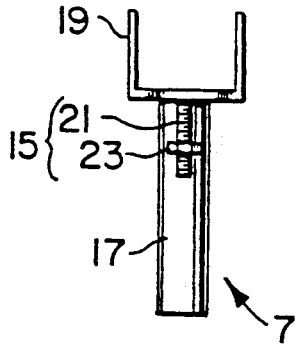
FIG. 3 is a side view of the saddle of FIG. 2.

Referring to FIG. 1, support 1 comprises a column 3 surmounted by a head 5, which carries a saddle 7. The height adjustment means 15 preferably comprises a plurality of rods 21, for instance a pair, each of which is threadably engageable with an individual nut of a plurality of nuts 23 rotatable on a corresponding upper surface of the head 5. The moment coupling means 17 advantageously comprises an unthreaded central member located between the rods and slidably engageable with the head 5. The upper surfaces of the support means 25 are preferably provided with apertures arranged substantially symmetrically about the upper end of the column for the insertion therethrough of the rods 21 and the unthreaded central member.

Figure 6:
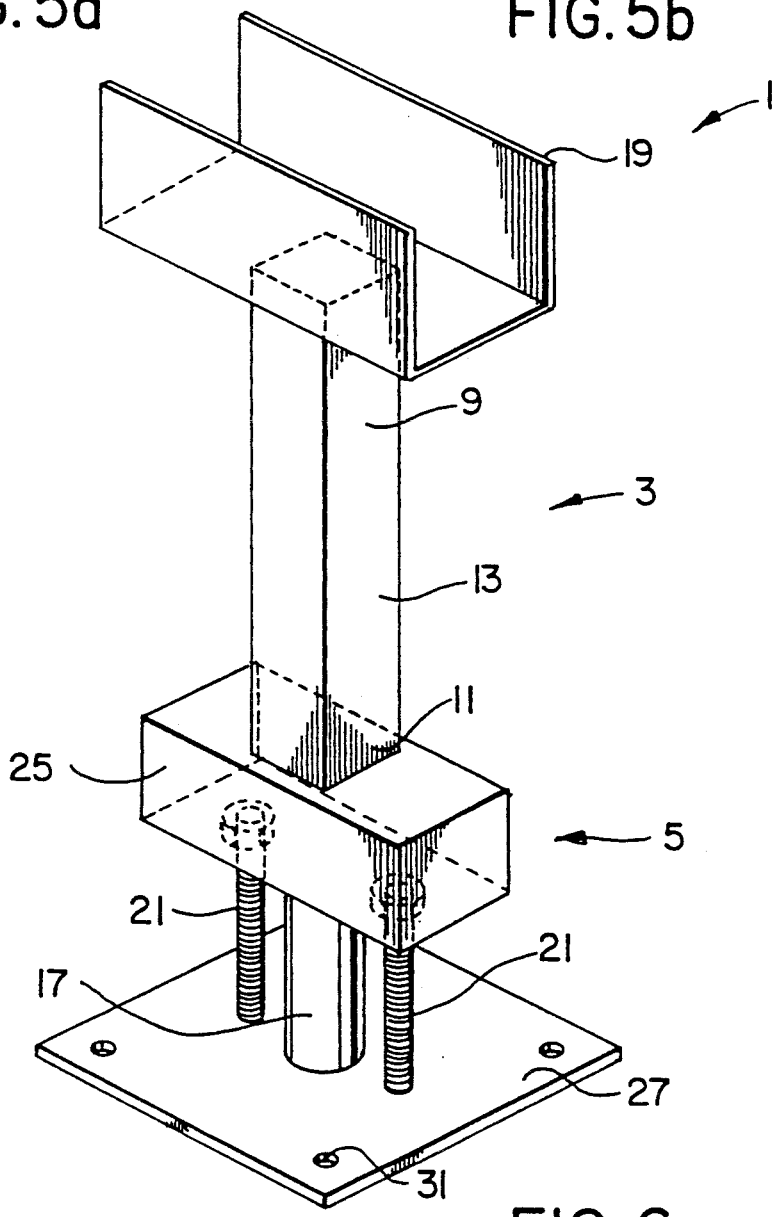
FIG. 6 is a perspective view of an alternative embodiment of a support column.

In the alternative support column shown in FIG. 6, the plurality of nuts 23 are each rotatable on a corresponding lower surface, rather than on an upper surface as shown in the embodiment depicted in FIG. 1. Similarly, in the embodiment shown in FIG. 6, it is the lower, rather than upper, surfaces of the support means 25 that are provided with apertures, and such apertures and support means 25 are arranged substantially symmetrically about the lower end 11, rather than upper end 9, of the column 3.

The column 3 comprises an upper end 9 and a lower end 11 with a shaft 13 therebetween. The shaft 13 may, for example, be of square or rectangular cross-section but other cross-sectional shapes, such as circular, are, of course possible. The column 3 may be constructed, for example, from heavy duty tubular square steel column sized to suit the load to be supported. A base plate 27 is disposed below the lower end 11 of the column 3 and optionally fixed thereto as shown in FIG. 1. Alternatively, the base plate 27 may, as shown in FIG. 6, be fixed to the central member of the moment coupling means 17 and to the plurality of rods 21. Such a base plate 27 may, for example, be disposed substantially perpendicularly to the column 3 and be adapted for connection to a footing (not shown), for example by means of holes 31 capable of receiving anchor bolts (not shown), or to a ground surface or to any other surface.

Figure 4:
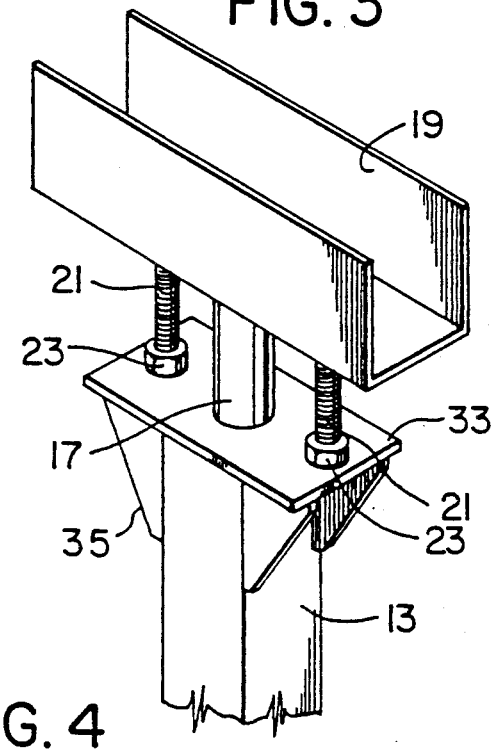
FIG. 4 is a perspective view of an embodiment of a saddle and alternative support means.
Figure 5A:
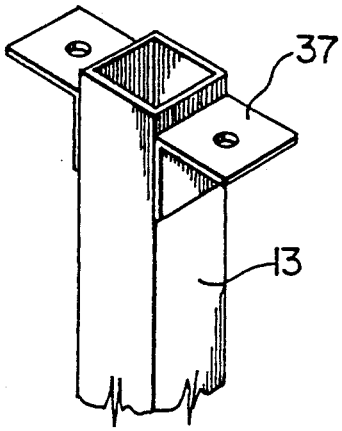
FIGS. 5*a* and 5*b* are perspective views of further alternative embodiments of support means.
Figure 5B:
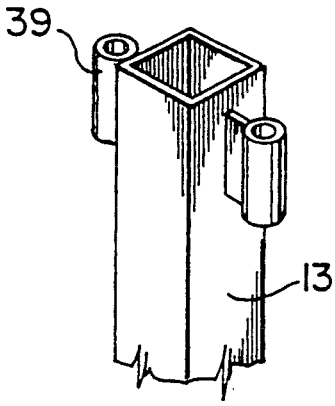

Support means 25 of the head 5 may, for example, be of substantially rectangular cross-section, as shown in FIG. 1. Alternatively, support means 25 may comprise a flat plate or bar 33 of suitable thickness as shown in FIG. 4. As also shown in FIG. 4, gussets 35 may be provided between the plate or bar 33 and the shaft 13 to stiffen the plate or bar 33. In the further alternative, support means 25 may comprise support clips. Such support clips may, for example, comprise angle brackets 37, as shown in FIG. 5*a*, or tubular appendages 39, as shown in FIG. 5*b*. The support means 25 is shown in FIG. 1 as disposed on the upper end 9 of the column 3 and in FIG. 6 as disposed on the lower end 11 of the column 3. The saddle 7 may, according to the embodiment shown in FIG. 1, comprise primarily a load engaging member 19 and a height adjustment means 15. Preferably, the load engaging member 19 and the support means 25 are in substantially parallel alignment to each other.

The height adjustment means 15 of the saddle 7 comprises a plurality of rods 21 each of which is threadably engageable with a corresponding individual nut 23 of a plurality of such nuts rotatable on a surface of the head 5, each rod and nut combination affording individual adjustability of the height and level of the saddle 7. Preferably a pair of rods 21 is provided. A telescopic moment coupling means 17 is disposed vertically between the support means 25 and the saddle 7. Holes through which the moment coupling means 17 and the plurality of rods 21 are inserted are shown in FIGS. 5*a* and 5*b*. The moment coupling means 17 is an unthreaded central member which may, for example, be substantially tubular, and may, for example, be substantially circular in cross-section. The moment coupling means 17 may alternatively be solid and other than circular in cross-section.

The load engaging member 19 of the saddle 7 may, for example, be of substantially rectangular cross-section, or may, for example, present an upwardly opening substantially U-shaped cross-section. As well, the load engaging member 19 may include holes 29 purposed for engagement of beams by fastening means such as, for example, nails or rivets. Furthermore, the load engaging member may, for example, comprise a plate suitable for being secured rigidly to a load such as, for example, a wide flange steel beam, although such a plate is generally not suitable as a load engaging member for wooden beams.

As will be apparent to those skilled in the art, support 1 may be constructed in a large range of heights and carrying capacities and over a large range of cross-sectional dimensions for column 3. Given the disposition of the head 5, the column 3 may be cut to length in the field and the head 5 then installed. Similarly, the saddle 7 may be constructed to suit a wide range of load dimensions and shapes, including, for example, the facility of incorporating the support 1 into an otherwise ordinary stud wall.

It will be obvious to those skilled in the art that the scope of the present invention is not restricted to the embodiments disclosed above, but may instead be varied within the scope of the following claims without departing from the spirit and scope of the invention.

I claim:

1. A load bearing support comprising:

a supporting column;

a head surmounting said supporting column; and a saddle disposed on said head;

said saddle extending upwardly to form a load engaging member and including;

height adjustment means for adjusting the overall height of the support, said height adjusting means comprising a plurality of rods fixedly attached to said saddle, each of said plurality of rods being threadably engageable with a respective one of a plurality of nuts rotatable on a corresponding upper surface of said head, and moment coupling means arranged substantially symmetrically about and substantially parallel to the longitudinal axis of said column, said moment coupling means comprising a central member fixedly attached to said saddle and slidably engageable with said head so as substantially prevent lateral movement of said saddle relative to the head;

said head being fixedly disposed at the top of said column, and comprising a saddle support means for said saddle, said saddle support means being disposed substantially perpendicularly to the longitudinal axis of said column, and substantially symmetrically about the upper end of said column whereby the head is adapted to slidably cooperate with said moment coupling means, and the upper surfaces of said saddle support means are adapted to cooperate with and support said height adjustment means.

2. The support as claimed in claim 1, wherein the upper surfaces of said saddle support means are arranged substantially symmetrically about the upper end of said supporting column and are provided with apertures for the insertion therethrough of said plurality of rods and of said central member.

3. The support as claimed in claim 1 or 2 further comprising a base plate connected substantially perpendicularly to said supporting column at the base thereof and intended for connection to a footing or ground surface.

4. The support as claimed in claim 1 or 2, wherein said supporting column and said saddle support means are each substantially rectangular in cross-section.

5. The support as claimed in claim 1, or 2, wherein said load engaging member presents an upwardly opening substantially U-shaped cross-section.

6. The support as claimed in claim 1, wherein the number of rods in said plurality of rods is two.

7. A support as claimed in claim 1 or 2, wherein said central member is unthreaded and tubular.

8. The support as claimed in claim 1 or 2, wherein said central member is unthreaded and substantially circular in cross-section.

9. The support as claimed in claim 1 or 2, wherein said load engaging member includes holes to allow fastening means to extend therethrough to engage said load.

10. The support as claimed in claim 1 or 2, wherein said load engaging member and said saddle support means are substantially parallel to each other.

* * * * *